United States Patent [19]

Bryan et al.

[11] Patent Number: 4,713,322

[45] Date of Patent: Dec. 15, 1987

[54] SILVER HALIDE PHOTOSENSITIVE MATERIAL

[75] Inventors: Philip S. Bryan; Arthur H. Herz, both of Rochester, N.Y.

[73] Assignee: Eastman Kodak Company, Rochester, N.Y.

[21] Appl. No.: 947,454

[22] Filed: Dec. 29, 1986

[51] Int. Cl.[4] ..... G03C 1/02; G03C 1/06

[52] U.S. Cl. ..... 430/569; 430/600; 430/603; 430/611

[58] Field of Search ..... 430/251, 455, 569, 600, 430/603, 611

[56] References Cited

U.S. PATENT DOCUMENTS 3,021,215 2/1962 Williams et al. ..... 430/603
3,046,129 7/1962 Graham et al. ..... 430/377

FOREIGN PATENT DOCUMENTS 85420 7/1978 Japan ..... 430/603

*Primary Examiner*—Richard L. Schilling
*Assistant Examiner*—Patrick Doody
*Attorney, Agent, or Firm*—Thomas F. Kirchoff

[57] ABSTRACT

A photographic silver halide emulsion comprising a thioether compound having more than 2 sulfur atoms in alkyl chains substituted on benzene nuclei. The compounds are useful in enhancing silver halide crystal growth. A process for preparation of the emulsion is also described.

17 Claims, No Drawings

SILVER HALIDE PHOTOSENSITIVE MATERIAL

The present invention relates to a silver halide photographic emulsion and to a process for preparation thereof. In particular, this invention relates to a silver halide emulsion comprising one or more thioether substituted compounds.

Thioether compounds are recognized as having a variety of uses in photography, including use as ripening and sensitizing agents for silver halide grains. For example, Japanese Patent Publication No. 85420/1978 (priority of Jan. 6, 1977) discloses thioether compounds which are stated to be capable of enhancing the sensitivity and growth rate of photographic silver halide grains without causing undesirable increases in fog formation during storage prior to use. The described thioether compounds comprise terminal carboxy groups on alkyl thioether chains bonded to a benzene nucleus. However, as is shown below by comparative data, the thioether compounds of this Patent Publication fail to impart the growth enhancement and fog reduction which can be obtained with compounds of this invention.

U.S. Pat. No. 3,021,215 describes long chain polythiaalkylenediol compounds as being useful sensitizing agents for silver halide. These compounds contain sulfur atoms which are separated from each other by alkylene groups. However, the described compounds do not provide sufficient ripening properties and, as shown below by comparative data, cause unacceptably high levels of fog formation during storage prior to use.

Accordingly, the objects of the present invention are to provide a photographic silver halide emulsion, and a process for preparation thereof, which emulsion comprises a compound which improves silver halide crystal growth rates and which imparts superior ripening properties without causing fog formation upon extended storage thereof.

According to the present invention improvements in photographic properties of a silver halide emulsion are obtained by incorporating therein a thioether compound having the structural formula:

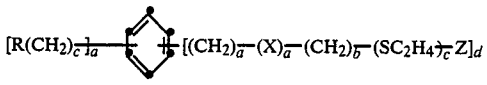

(I)

wherein

R is —COOH;

X is oxygen or sulfur;

each a is independently 0 or 1;

b is 0, 1, 2 or 3;

each c is independently 0, 1 or 2;

d is from 2 to 6; and

Z is a group having the formula $—S(CH_2)_nCOOH$, $—S(CH_2)_nCH_2OH$, $—OCH_2CH_3$ or $—NHCOCH_2CH_2COOH$, where n is from 1 to 6, or an alkali metal or ammonium salt thereof;

with the proviso that the thioether compound comprises more than 2 sulfur atoms.

A surprising feature of this invention is the dramatic increase in silver halide growth rates during ripening. These highly desirable increases in growth rates are obtained through multiple thioether groups in the alkyl side chains of compounds falling within the structural formula noted above.

Preferred thioether compounds of this invention are those having the structure of formula II:

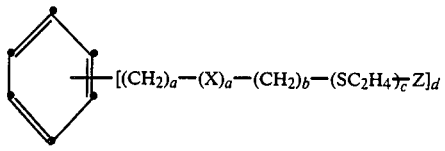

(II)

wherein

Z is $—S(CH_2)_nCOOH$ or $—S(CH_2)_nCH_2OH$;

d is 2 and X, a, b, c and n are as defined above in formula I, with the proviso that the thioether compound comprises at least 4 sulfur atoms.

Specific examples of thioether compounds falling within the description of this invention include:

1.

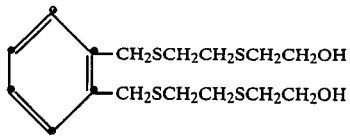

2.

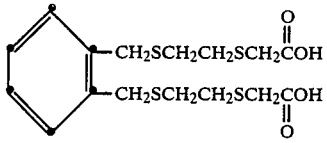

3.

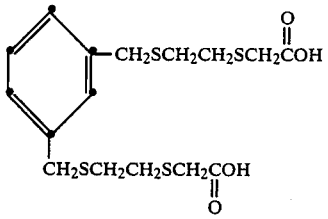

4.

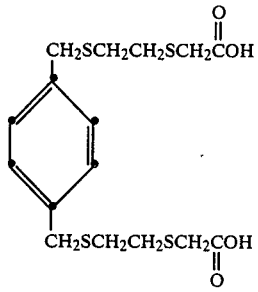

5.

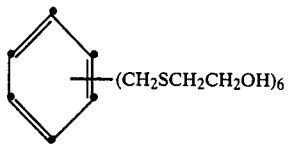

6.

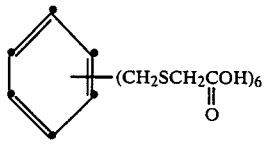

-continued

7.

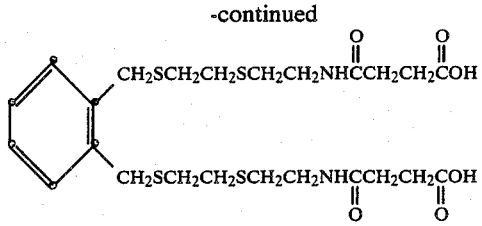

8.

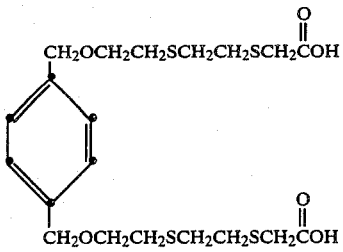

9.

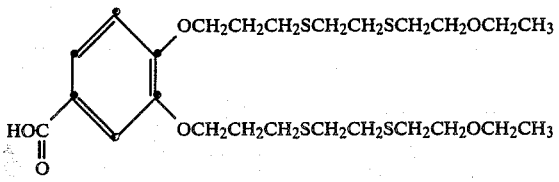

10.

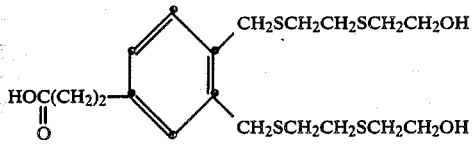

11.

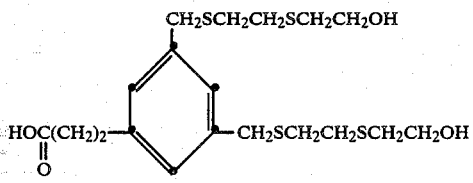

12.

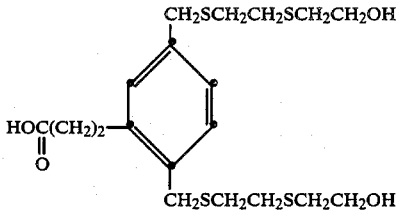

Particularly preferred compounds described herein are those which have the thioether containing substituents present on the benzene ring in positions ortho or meta to each other.

The thioether compounds described herein can be synthesized by several methods. Scheme I, shown below, comprises reacting a halomethyl substituted benzene compound with a thiol compound in base:

I

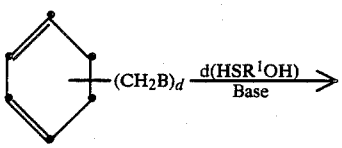

-continued

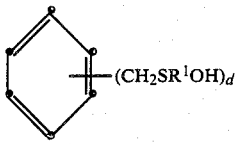

where $R^1$ is an alkylene group, B is a halogen atom and d is an integer of from 2 to 6. Another synthetic technique is shown in Scheme II which comprises reacting, in base, an aromatic polyol compound with a halosubstituted thioether compound:

II

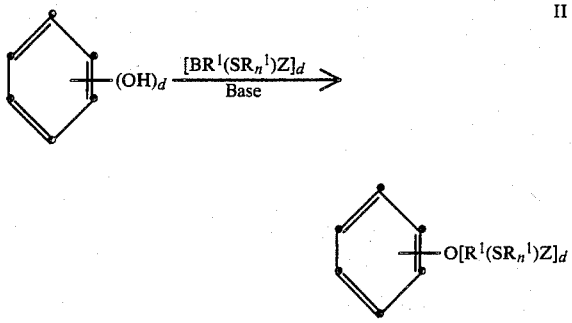

where B, $R^1$, Z and d are as described above and n is an integer of 2 or 3. Other thioether compounds described herein can be prepared in a stepwise manner as shown in the following Scheme III:

III

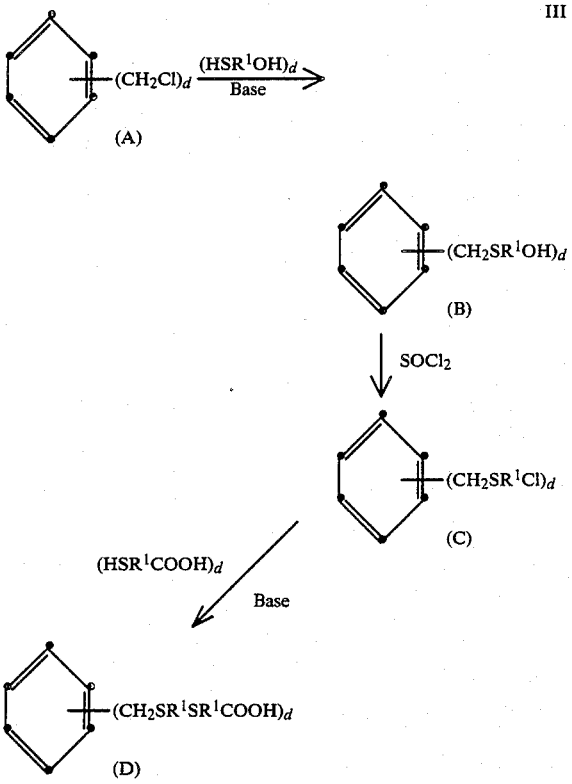

where $R^1$ and d are as described above.

Specific synthetic preparations of compounds falling within this invention are illustrated as follows:

SYNTHESIS 1

Preparation of Compound 4 (Scheme III)

To 3.9 g (0.050 mole) of 2-mercaptoethanol in 25 ml of methanol was added 100 ml of 0.5M of sodium methoxide in methanol. After the addition of 6.0 g (0.023 mole) $\alpha,\alpha'$-dibromo-p-xylene, the resulting solution was heated at reflux under nitrogen for 5 days. The solvent was removed and the resulting white solid was washed with water and dried. Recrystallization from chloroform yielded 4.7 g of the dialcohol precursor, $C_{12}H_{18}O_2S_2$, which was then converted to the dichloride as follows:

The dialcohol (4.7 g, 0.018 mole) was dissolved in 70 ml of chloroform and placed in a 3 neck 250 ml flask fitted with a condenser, a drying tube and a dropping funnel which contained 10.8 g (0.09 mole) of thionyl chloride. The thionyl chloride was added dropwise over 45 min and the solution was stirred overnight at room temperature. The solution was evaporated in vacuo to an oil which was dissolved in methylene chloride. The solution was washed three times with saturated sodium bicarbonate solution, once with water and then dried over $MgSO_4$. The solvent was removed and the solid was isolated and washed with cold hexane to yield 4.2 g of the dichloride, $C_{12}H_{16}Cl_2S_2$. The dichloride was converted to Compound 4 by the following treatment.

To 120 ml of a 0.5M methanol solution of sodium methoxide was added 2.75 (0.03 mole) of mercaptoacetic acid and 4.2 g (0.014 mole) of the dichloride. The resulting solution was heated at reflux under nitrogen for 4 days. The solvent was removed and the residue was taken up in 150 ml of water and filtered. The filtrate was acidified to pH1 with HCl to yield a white solid which was recrystallized from chloroform/hexane; yield 3.5 g (44%).

SYNTHESIS 2

Preparation of Compound 5 (Scheme I)

Hexakis(bromomethyl)benzene was prepared as described by Backer in Recl. Trav. Chim. Pays-Bas., 54: 745 (1935). Then 5.0 g (0.0079 mole) of this material was added to a solution prepared by dissolving 1.8 g (0.079 mole) of sodium metal in 225 ml absolute alcohol and adding 6.17 g (0.079 mole) of 2-mercaptoethanol. After the solution was heated at reflux under nitrogen for 3 days, the solvent was removed and 150 ml of water was added to the resulting solid. The solid was collected and recrystallized twice from 7:1 water-ethanol; yield 3.65 g of white solid (75%).

This invention also provides a process for preparation of a silver halide emulsion which comprises adding from about 0.001 to about 10 g of a thioether compound, as described above, to said emulsion during preparation thereof or prior to coating the emulsion on a support.

In the present invention the described thioether compounds may be added to the silver halide emulsion at various stages during preparation. They may be added singly or in combination with other ripening agents, including other thioether compounds or their silver complexes. For example, the compounds may be added during formation of silver halide grains, during the physical or chemical ripening stage, or in a separate step before coating. The silver halide grains can be formed according to processes generally well known in the art, with a double jet type process being preferred.

The double jet process comprises adding a silver nitrate aqueous solution and an aqueous solution of one or more halides (e.g., an alkali metal halide such as potassium bromide) simultaneously to a stirred solution of silver halide-protecting colloid (e.g., gelatin or gelatin derivative) through two separate jets. A thioether compound as described herein is preferably added to the protective colloid solution before initiation of silver halide formation.

Conditions for forming silver halide grains such as pH, pAg, temperature, etc., are not particularly limited when employed using compounds described herein. The pH is generally about 1 to 9, preferably about 2 to 6, and pAg is generally about 5 to 11, preferably about 7.0 to 10.0. Silver halide grains may be formed at temperatures between about 30° to about 90° C., with about 35° C. to about 80° C. being preferred.

An organic thioether compound as described herein is preferably added during precipitation of silver halide grains and/or during ripening in an amount of from about 0.001 to 10 g, preferably about 0.01 to 1 g, per mol of silver halide.

When an acid substituted thioether compound of the type disclosed herein remains in a silver halide emulsion following preparation thereof, a reduction in fog formation upon extended storage is often obtained. An effective concentration to retard such fog formation is from about $10^{-6}$ to about $0.5\times10^{-2}$ mol of the thioether compound per mol of silver halide.

Gelatin is preferred as the binder or protective colloid for the photographic emulsion of the present invention. However, other hydrophilic colloids are also suitable. For example, proteins such as gelatin derivatives, graft polymers of gelatin and other polymers, albumin, casein, cellulose derivatives such as hydroxyethyl cellulose, carboxymethyl cellulose, cellulose sulfate, sugar derivatives such as sodium alginate, starch derivatives and various synthetic hydrophilic homopolymers or copolymers such as polyvinyl alcohol, poly-N-vinylpyrrolidone, polyacrylic acid, polymethacrylic acid, polyacrylamide, polyvinylimidazole, polyvinyl pyrazole can be used.

Acid-processed gelatin can be used as well as lime-processed gelatin. Further, gelatin hydrolyzates, and enzyme-hydrolyzed products of gelatin are also usable.

Surface active agents may be incorporated in a photographic emulsion layer or in another hydrophilic colloid layer as a coating aid to prevent build-up of static charge, to improve lubrication properties, to improve emulsion dispersion, to prevent adhesion, and to improve such photographic characteristics as acceleration of development, increase in contrast, or sensitization.

A photographic emulsion of the present invention can be applied to many different silver halide photographic light-sensitive materials due to its high photographic sensitivity, contrast, and fog reduction. For example, it can be used in high speed black-and-white negative films, in X-ray films and in multilayer color negative films.

A photographic emulsion of the present invention may contain antifogging agents or emulsion stabilizing agents, such as for example azaindenes, thionamides, azoles and the like.

The photographic emulsion of the present invention may be spectrally sensitized with dyes. Dyes which can be used include cyanine dyes, merocyanine dyes, composite cyanine dyes, composite merocyanine dyes, and hemioxonol dyes. Particularly useful dyes are those belonging to the merocyanine class. These dyes contain as a basic heterocyclic ring nucleus any nucleus ordinarily used in cyanine dyes.

The photographic emulsion of the present invention may contain color image-forming couplers, i.e., compounds capable of reacting with an oxidation product of an aromatic amine (usually a primary amine) to form a dye. Non-diffusing couplers containing a ballast group are desirable. Either 4-equivalent and 2-equivalent couplers are usable. In addition, colored couplers showing the effect of color correction, or couplers releasing a development inhibitor upon development (so-called DIR couplers) may be used.

A photographic emulsion of the present invention is coated on a support conventionally used for photographic light-sensitive materials such as a flexible support (e.g., plastic film, paper, etc.) or a rigid support (e.g., glass, etc.) according to a dip-coating method, roller coating method, curtain coating method or extrusion coating method.

Emulsions of the present invention can be applied to a multilayer multicolor photographic material comprising a support having provided thereon at least two layers having different spectral sensitivities. Multilayer multicolor photographic materials usually comprise a support having provided thereon at least one red-sensitive emulsion layer, at least one green-sensitive emulsion layer, and at least one blue-sensitive emulsion layer. The order of these layers can optionally be selected as occasion demands. Usually, a cyan-forming coupler is associated with the red-sensitive emulsion layer, a magenta-forming coupler is associated with the green-sensitive emulsion layer, and a yellow-forming coupler is associated with the blue-sensitive emulsion layer. In some cases, however, different layer arrangements may be employed.

The photographic emulsions obtained by the present invention can be processed according to known methods. A developer to be used for the black-and-white processing can contain conventional developing agents such as dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolidines or ascorbic acids.

As color-developing agent, there can be used primary aromatic amine developing agents such as phenylenediamines (e.g., 4-amino-N,N-diethylaniline, 3-methyl-4-amino-N,N-diethylaniline, 4-amino-N-ethyl-N-hydroxy-ethylaniline, 3-methyl-4-amino-N-ethyl-N-hydroxyethylaniline, 3-methyl-4-amino-N-ethyl-N-methanesulfonamidoethylaniline and 4-amino-3-methyl-N-ethyl-N-methoxyethylaniline. In addition, the developing agents described in L. F. A. Mason, Photographic Processing Chemistry (Focal Press, 1966), pp. 226–229, as well as those described in U.S. Pat. Nos. 2,193,015 and 2,592,364 may be used.

The present invention is described in further detail by the following non-limiting examples.

EXAMPLE I

The ripening activity of compounds of this invention compared with prior art compounds was determined from Rayleigh scatter measurements of dispersed silver halides (L. Oppenheimer, T. H. James and A. H. Hertz in "Particle Growth in Suspensions", A. L. Smith, Editor, Academic Press, London, 1973, pp. 159–178).

Tests for silver halide growth rates were carried out with about 1 mM AgBr suspended in 0.1% gelatin (isoionic point 4.9), 30 vol. % methanol, at pBr 3, pH3, 25° C. Additive concentrations were 0.2 mmol per liter AgBr suspension. Turbidity was determined as a function of time and the linear plot (slope rate) thus obtained is taken as a measure of AgBr growth (or ripening) rate. Results, recorded in Table I, include use of Compounds 1 to 4 of this invention as identified above.

TABLE I

| Thioether Compound | AgBr Growth Rate |
|---|---|
| none (control) | 1.0[1] |
| A[2] | 1.0 |
| B[2] | 2.1 |
| 1 | 47.0 |
| 2 | 25.0 |
| 3 | 11.0 |
| 4 | 8.0 |

[1]Reference against which other rates are related
[2]Compound A is

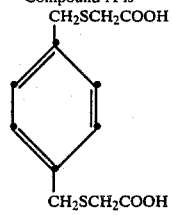

which falls within the disclosure of Japanese Patent Application No. 85420/1978. Compound B is 3,6-dithia-1,8-octanediol, identified as Compound 1, in Table 1, of U.S. Pat. No. 3,021,215.

Table I shows thioether compounds 1 to 4 of this invention to be appreciably more active as ripening agents than the indicated compounds of the prior art.

EXAMPLE 2

When a thioether compound as described herein is incorporated in a chemically sensitized high speed silver halide emulsion it causes less fog as compared with a prior art thioether ripening agent. This is demonstrated below.

The compounds identified in Table II were added at concentrations of 10 mmols/mol Ag and at 40° C. to a sulfur and gold-sensitized negative AgBrI gelatin emulsion containing about 0.001M KBr, at about pH6. The emulsions were coated and processed in a hydroquinone/monomethyl-p-aminophenol sulfate type developer such as those commercially available under the tradenames Kodak Developers DK-50 or D-19. Accelerated aging tests were carried out by storing coatings for 1 week at 49° C./50% relative humidity (RH). Results are recorded in Table II.

TABLE II

| Thioether Compound | Fog | |
|---|---|---|
| | Fresh | After Storage |
| B[1] | 0.75 | 1.82 |
| 3 | 0.21 | 0.21 |

[1]Compound B is identified above in Example I.

From these results it is apparent that Compound 3 appreciably reduces not only initial fog but also fog formation during storage under elevated temperature and humidity conditions.

While the above examples illustrate use of this invention with respect to silver bromide in excess bromide ion, the invention is also applicable to other silver halide compositions including AgBrI, AgClI and AgClBr, as well as silver chloride dispersions containing excess chloride ion and silver iodide dispersions containing excess ion.

The thioether compounds described herein have also been found to form silver complexes that do not yield sulfide ions which cause adverse sensitometric changes. These thioether compounds are active solvents and are capable of dissolving silver halide in aqueous dispersions, for example in silver salt diffusion transfer systems.

This invention has been described in detail with particular reference to preferred embodiments thereof, but it will be understood that variations and modifications can be effected within the spirit and scope of the invention.

What is claimed is:

1. A silver halide photographic emulsion comprising a thioether compound having the structural formula

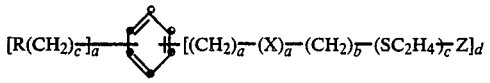

wherein

R is —COOH;

X is sulfur or oxygen;

each a is independently 0 or 1;

b is 0, 1, 2 or 3;

each c is independently 0, 1 or 2;

d is from 2 to 6; and

Z is a group having the formula $—S(CH_2)_nCOOH$; $—S(CH_2)_nCH_2OH$; $—OCH_2CH_3$ or $—NHCOCH_2CH_2COOH$, where n is from 1 to 6, or an alkali metal or ammonium salt thereof;

with the proviso that said compound comprises more than 2 sulfur atoms.

2. The photographic emulsion of claim 1 wherein the compound has the structural formula:

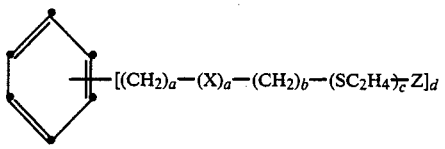

wherein

Z is $—S(CH_2)_nCOOH$ or $—S(CH_2)_nCH_2OH$ and d is 2 with the proviso that the thioether compound comprises at least 4 sulfur atoms.

3. The photographic emulsion of claim 1 wherein thioether substituents are present in positions ortho or meta to each other.

4. The photographic emulsion of claim 1 wherein the compound is present in an amount of from about 0.001 to about 10 g thereof per mol of silver halide.

5. The photographic emulsion of claim 4 wherein the compound is present in an amount of from about 0.01 to about 1 g thereof per mol of silver halide.

6. The photographic emulsion of claim 1 wherein the compound is present in an amount of from about $10^{-6}$ to about $0.5\times10^{-2}$ mole of said compound per mole of silver halide.

7. The photographic emulsion of claim 1 wherein the compound is:

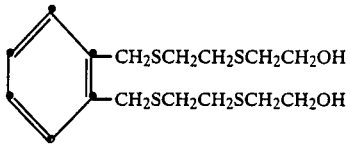

8. The photographic emulsion of claim 1 wherein the compound is

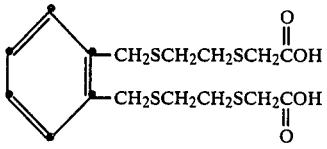

9. The photographic emulsion of claim 1 wherein the compound is

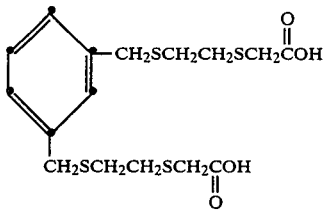

10. The photographic emulsion of claim 1 wherein the compound is

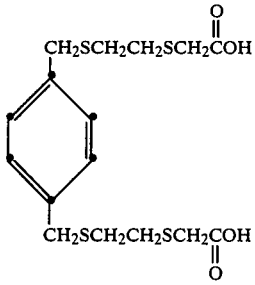

11. The photographic emulsion of claim 1 wherein the compound is

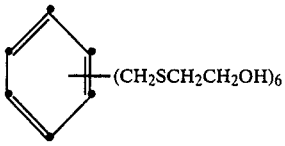

12. The photographic emulsion of claim 1 wherein the compound is

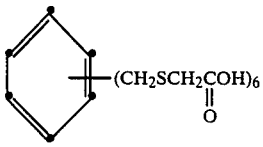

13. In a process for the preparation of a silver halide emulsion, the improvement which comprises adding, during preparation of said emulsion or prior to coating thereof on a support, from about 0.001 to about 10 g per mol of silver halide of a compound having the structural formula:

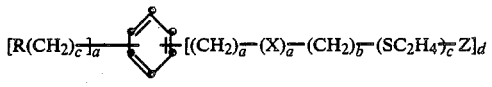

wherein

R is COOH;

X is sulfur or oxygen;

each a is independently 0 or 1;

b is 0, 1, 2 or 3;

each c is independently 0, 1 or 2;

d is from 2 to 6; and

Z is a group having the formula $—S(CH_2)_nCOOH$; $—S(CH_2)_nCH_2OH$; $—OCH_2CH_3$ or $—NHCOCH_2CH_2COOH$, where n is from 1 to 6, with the proviso that said compound comprises more than 2 sulfur atoms.

14. The process of claim 13 wherein said thioether compound has the structural formula:

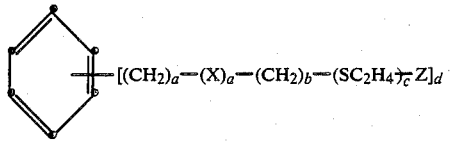

wherein

Z is $—S(CH_2)_nCOOH$ or $—S(CH_2)_nCH_2OH$ and d is 2 with the proviso that the thioether compound comprises at least 4 sulfur atoms.

15. The process of claim 13 wherein said compound is added during silver halide formation or during ripening.

16. The process of claim 13 wherein said compound is added in an amount of from about 0.01 to about 1 g thereof per mol of silver halide.

17. A silver halide emulsion prepared by the process of claim 13, 14, 15 or 16.

* * * * *